US005405456A

United States Patent [19]

Wu et al.

[11] Patent Number: 5,405,456

[45] Date of Patent: Apr. 11, 1995

[54] PROCESS OF SURFACE HARDENING FOR TITANIUM ALLOY BY MOLTEN SALT CARBURIZATION

[75] Inventors: Jiann-Kuo Wu, Taipei; Tair-I Wu, Yi-Lan, both of Taiwan, Prov. of China

[73] Assignee: National Science Council, Taipei, Taiwan, Prov. of China

[21] Appl. No.: 139,927

[22] Filed: Oct. 21, 1993

[51] Int. Cl.[6] ..... C23C 8/44

[52] U.S. Cl. ..... 148/224; 148/237; 205/322; 427/431

[58] Field of Search ..... 427/249, 431; 148/224, 148/209, 210, 237; 205/322

[56] References Cited

U.S. PATENT DOCUMENTS

| | | | |
|---|---|---|---|
| 3,553,038 | 10/1966 | Ader | 148/224 |
| 3,885,059 | 5/1975 | Komatsu et al. | 427/431 |
| 4,686,117 | 8/1987 | Arai et al. | 148/209 |
| 4,992,309 | 2/1991 | Omori et al. | 427/431 |

FOREIGN PATENT DOCUMENTS

| | | | |
|---|---|---|---|
| 2446327 | 8/1980 | France | 148/210 |

OTHER PUBLICATIONS

Refractory Hard Metals, (eds) Schwarzkopf et al, McMillan, N.Y. 1953, pp. 63–64.

Abstract (english): SU-3263663: Priority Date Mar. 24, 1981.

*Primary Examiner*—George Wyszomierski

*Attorney, Agent, or Firm*—Ladas & Parry

[57] ABSTRACT

Disclosed is a process of surface hardening for titanium alloys comprising α phase by carburization in a molten salt which consists of carbonate as the carbon-yielding agent with electrolysis within 790° C. to 930° C. The hardness within the effective carburizing layer is influenced by bath temperature, applied current density and carburizing period. The major hardening effect is due to the formation of solid solution of carbon in α-Ti.

7 Claims, 7 Drawing Sheets

PROCESS OF SURFACE HARDENING FOR TITANIUM ALLOY BY MOLTEN SALT CARBURIZATION

FIELD OF THE INVENTION

The present invention relates to a surface hardening process for titanium alloy comprising $\alpha$ phase which can be performed by carburization in a molten salt which contains carbonate.

DESCRIPTION OF RELATED ART

Titanium alloys find many uses in industrial applications (T. M. Muraleedharan and E. I. Meletis, "Surface Modification of Pure Titanium and Ti-6Al-4V by Intensified Plasma Ion Nitriding," Thin Solid Films, 211 (1992), pp. 104–113; A. Chen, K. Sridharan, J. R. Conrad and R. P. Fetherston, "Surface Modification of Ti-6Al-4V Alloy by Plasma Source Ion Implantation," Surf. and Coating Tech., 50 (1991), pp. 1–4; D. S. Dunn, S. Raghavan and R. G. Volz, "Anodized Layers on Titanium and Titanium Alloy Othorpedic Materials for Antimicrobial Activity Applications," Materials and Manufacturing Processes, 7(1) (1992), pp. 123–137; J. C. Pivin, "Tribology of Amorphous Diamond Films Grown or Modified by Ion Implantation," J. of Materials Science, 27 (24) (1992), pp. 6735–6742) due to their inert chemical properties, high temperature resistance and high strength-to-weight ratio, etc. However, wear behavior of titanium alloys in tribological environment is less satisfactory (J. C. Pivin, "Tribology of Amorphous Diamond Films Grown or Modified by Ion Implantation," J of . Materials Science, 27 (24) (1992), pp. 6735–6742; J. A. Davidson and A. K. Mishra, "Surface Modification Issues for Othorpaedic Implant Bearing Surfaces," Materials and Manufacturing Processes, 7 (3) (1992), pp. 405–421; A. Mucha and M. Braun, "Requisite Parameters for Optimal Wear Performance of Nitrogen-implanted Titanium and Ti-6Al-4V," Surf. and Coating Tech., 50(1992), pp. 135–139). The development of surface treating technology to improve the near surface properties such as: hardness, wear resistance, heat resistance and resistance to halide ions attack of titanium alloys has been extensive and progressive (T. M. Muraleedharan and E. I. Meletis, "Surface Modification of Pure Titanium and Ti-6Al-4V by Intensified Plasma Ion Nitriding," Thin Solid Films, 211 (1992), pp . 104–113; A. Chen, K. Sridharan, J. R. Conrad and R. P. Fetherston, "Surface Modification of Ti-6Al-4V Alloy by Plasma Source Ion Implantation, " Surf and Coating Tech , 50 (1991), pp. 1–4; D. S. Dunn, S. Raghavan and R. G. Volz, "Anodized Layers on Titanium and Titanium Alloy Othorpedic Materials for Antimicrobial Activity Applications," Materials and Manufacturing Processes, 7(1) (1992), pp. 123–137; J. C. Pivin, "Tribology of Amorphous Diamond Films Grown or Modified by Ion Implantation," J. of Materials Science, 27 (24) (1992), pp. 6735–6742). The newly developed techniques which have been widely used to enhance surface hardness of titanium alloys include ion implantation, chemical vapor deposition (CVD) and physical vapor deposition (PVD), etc. The application of conventional carburizing and nitriding processes which have long been adopted by the industry for the surface modification of ferrous alloys (Novy, R. F., G. L. Scott and T. O. Zurfluh, "Vacuum Carburizing," U.S. Pat. No. 4,160,680) to obtain a hardened surface layer of titanium alloys are scarcely reported (Yu. M. Lakhtin, "High Temperature Nitriding," Metal Science and Heat Treatment, 6 (1991), pp. 124–130).

SUMMARY OF THE INVENTION

It is therefore an object of the present invention to provide a process for surface hardening of titanium alloys.

The present invention for surface hardening a titanium alloy generally includes the following steps: submerging said titanium alloy in a molten salt containing carbonate which has an anode and a cathode therein; maintaining said titanium alloy in contact with said cathode; passing an electric current between said anode and cathode; disconnecting said titanium alloy with said cathode; and cooling said titanium alloy.

The further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. *1a* shows the transverse section of the microstructure of a mill-annealed alloy;

Figure 3A:
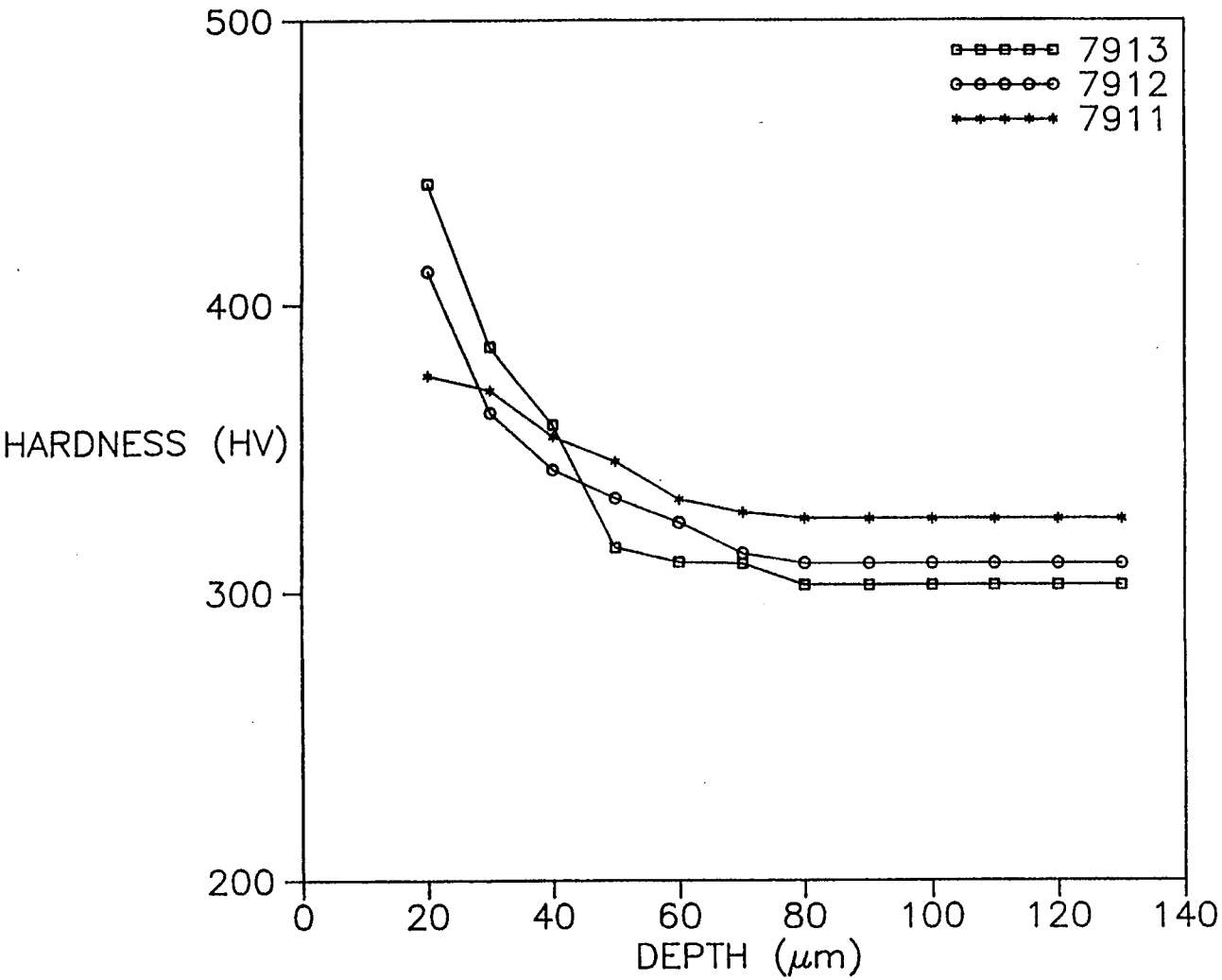
Figure 3B:
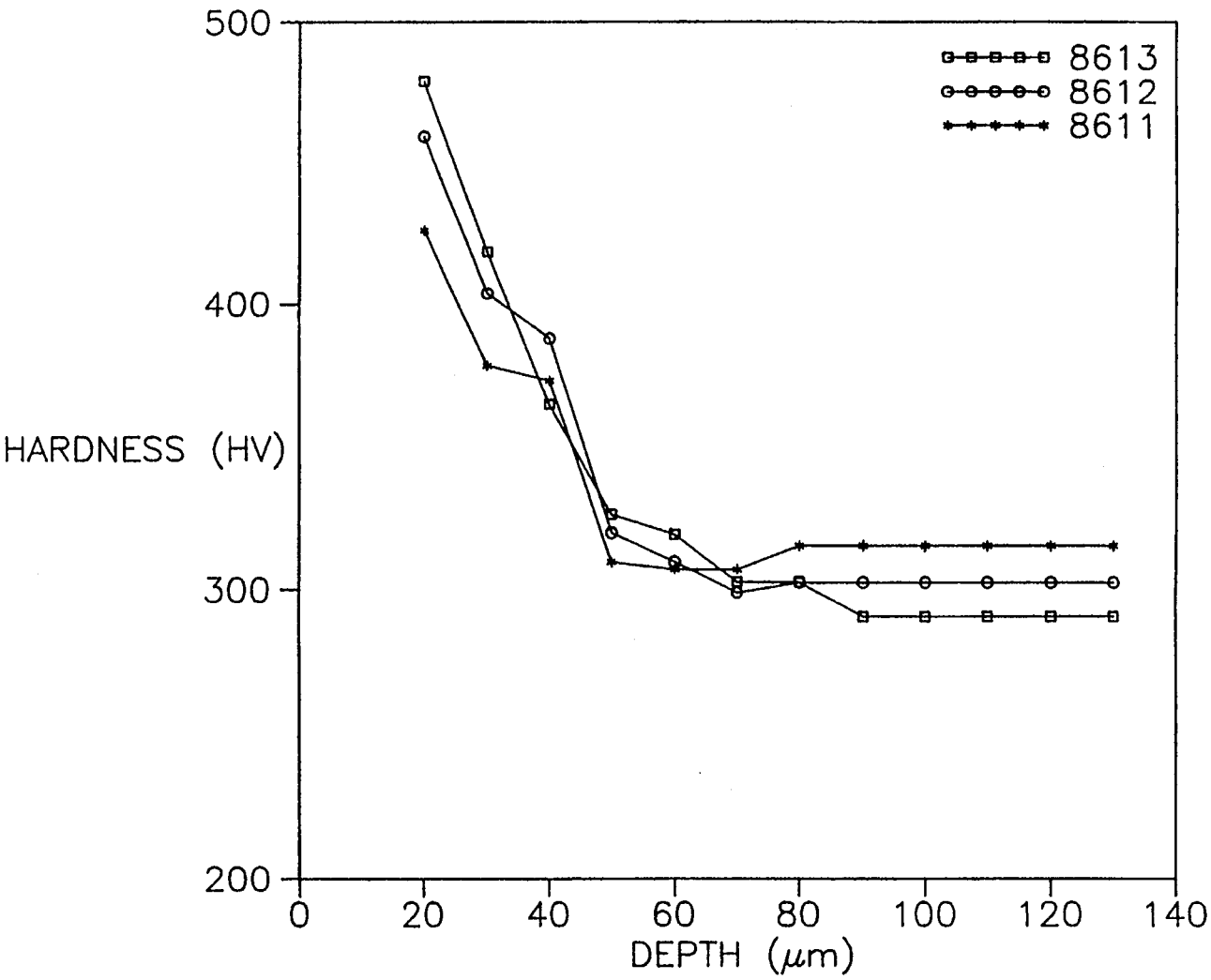
Figure 3C:
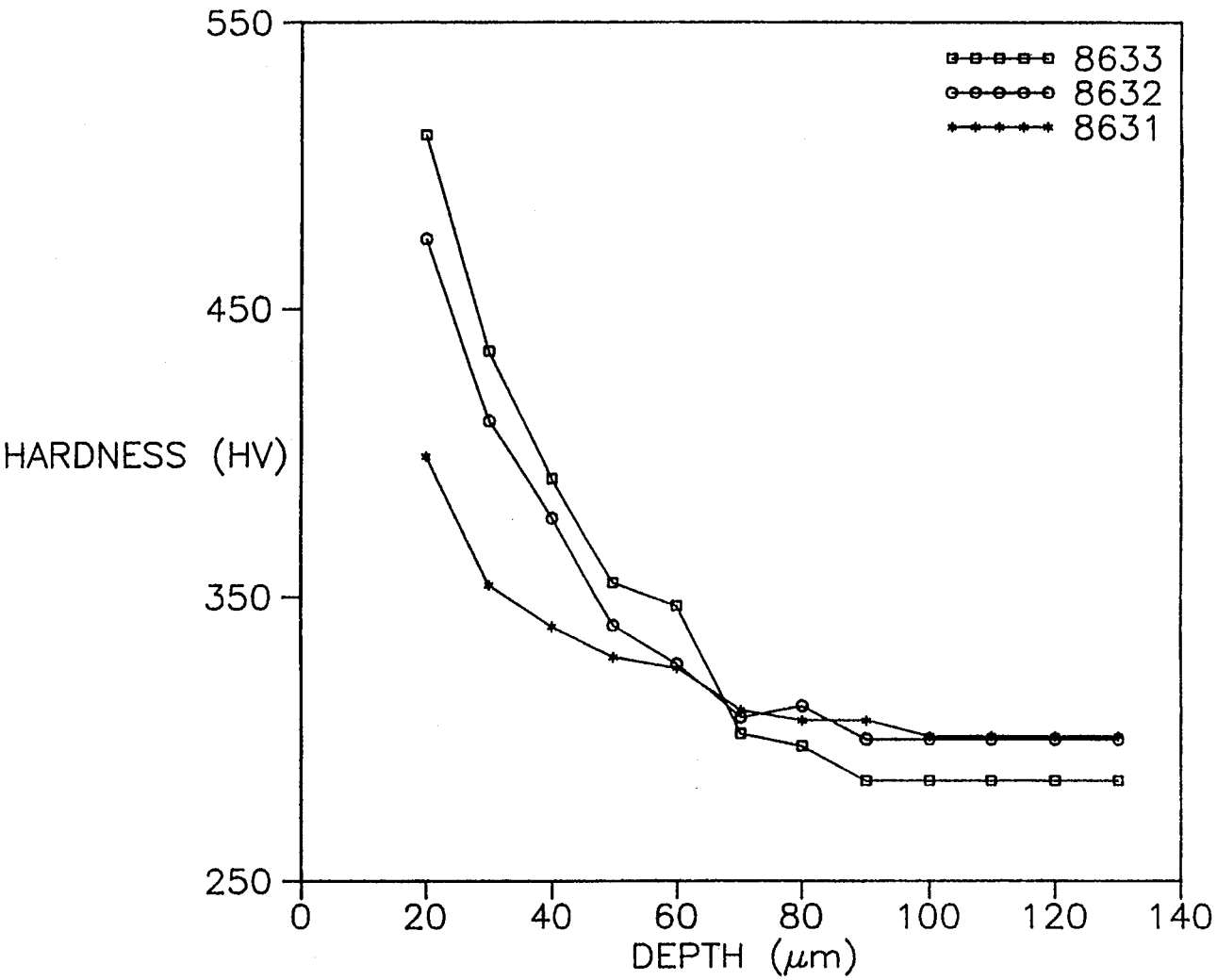
Figure 3D:
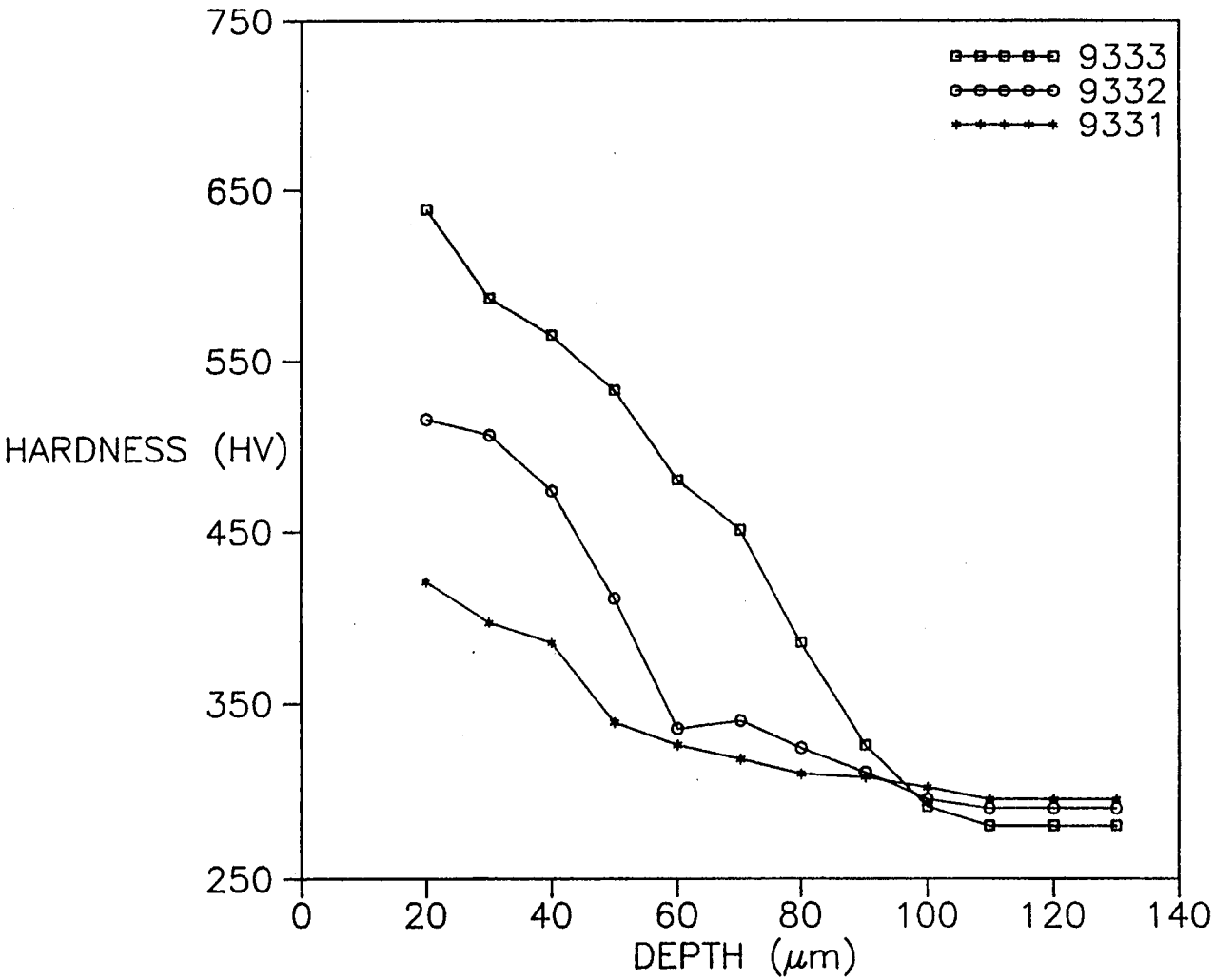
Figure 3E:
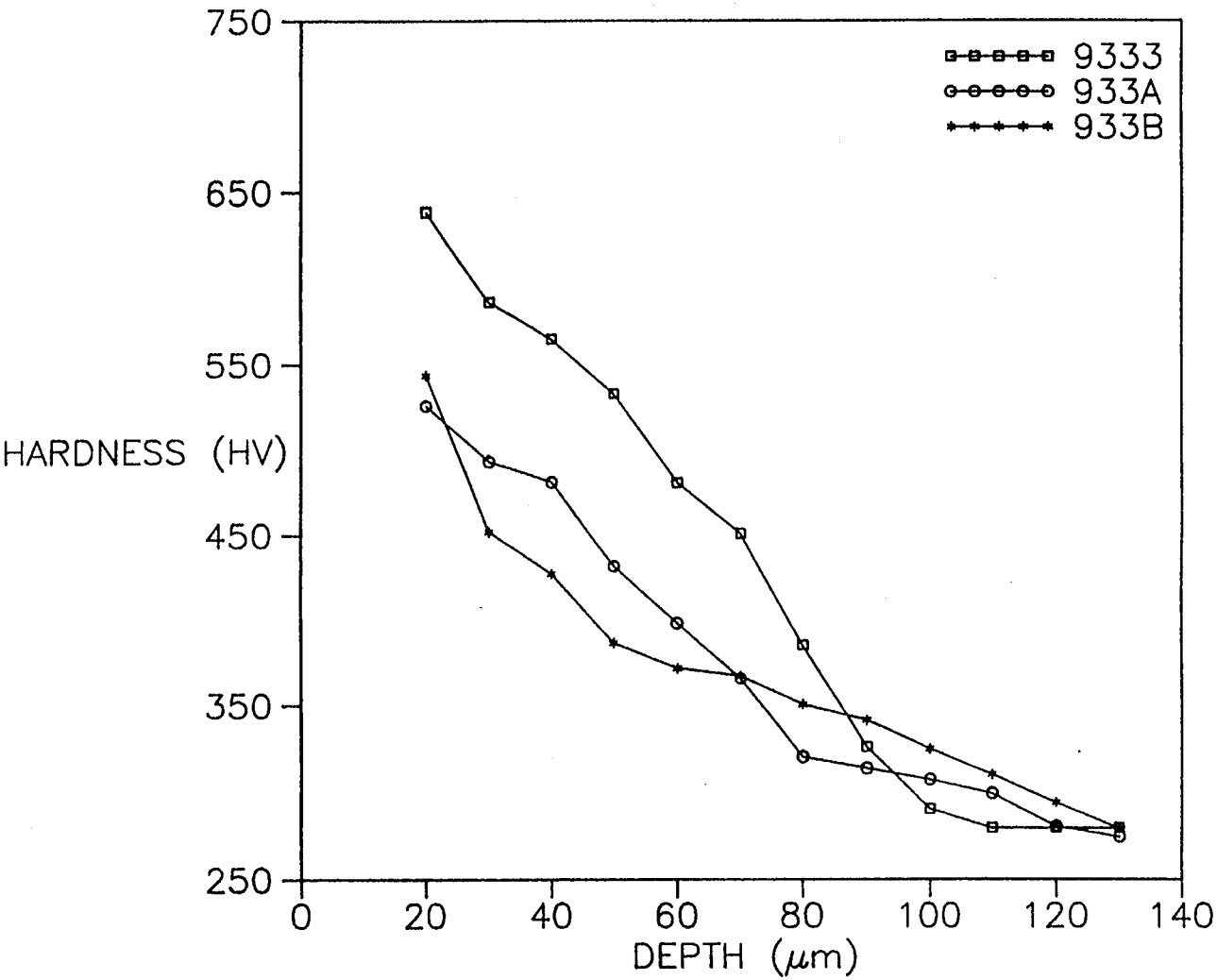

FIG. *1b* shows the longitudinal section of the microstructure of a mill-annealed alloy;

FIG. *2a* shows the cross sectional microstructure of specimen No. 7911;

FIG. *2b* shows the cross sectional microstructure of specimen No. 7912;

FIG. *2c* shows the cross sectional microstructure of specimen No. 7913;

FIG. *2d* shows the cross sectional microstructure of specimen No. 8611;

FIG. *2e* shows the cross sectional microstructure of specimen No. 8612;

FIG. *2f* shows the cross sectional microstructure of specimen No. 8613;

FIG. *2g* shows the cross sectional microstructure of specimen No. 8631;

FIG. *2h* shows the cross sectional microstructure of specimen No. 8632;

FIG. *2i* shows the cross sectional microstructure of specimen No. 8633;

FIG. *2j* shows the cross sectional microstructure of specimen No. 9331;

FIG. *2k* shows the cross sectional microstructure of specimen No. 9332;

FIG. *2l* shows the cross sectional microstructure of specimen No. 9333;

FIG. *2m* shows the cross sectional microstructure of specimen No. 933A;

FIG. *2n* shows the cross sectional microstructure of specimen No. 933B;

FIG. *3a* shows the hardness-depth distribution curves of the specimens treated under 790° C., 0.1 amp/cm$^2$;

FIG. *3b* shows the hardness-depth distribution curves of the specimens treated under 860° C., 0.1 amp/cm$^2$;

FIG. 3c shows the hardness-depth distribution curves of the specimens treated under 860° C., 0.3 amp/cm$^2$;

FIG. 3d shows the hardness-depth distribution curves of the specimens treated under 930° C., 0.3 amp/cm$^2$;

FIG. 3e shows the hardness-depth distribution curves of the specimens treated under 930° C., 0.3 amp/cm$^2$ with additional treatments.

DETAILED DESCRIPTION OF THE PREFERRED EMBODIMENT

The present invention will be described by the following experiment.

A Ti-6Al-4V alloy used in this experiment was received in mill-annealed condition. The chemical composition of the alloy is given in Table I.

TABLE I

| CHEMICAL COMPOSITION OF THE MILL-ANNEALED ALLOY | | | | | | | |
|---|---|---|---|---|---|---|---|
| Al | V | C | Fe | O | N | H | Ti |
| 6.48 | 4.27 | 0.044 | 0.204 | 0.16 | 0.012 | 0.0079 | balance |

Specimens, all of 2 mm in thickness, were cut from round bars stock 13 mm in diameter, of which the arithmetic mean value of their surface roughness $R_a$=0.168 μm, was measured after they had been ground with 150 grade emery paper in running water. Fifty sets of carburizing parameters listed in Table II were designated from 7911 to 933B. The experimental results are listed for comparison.

about 30% $BaCo_3$ by weight, and about 70% No. 660 by weight, No. 660 consisting of about 59% $BaCl_2$ by weight, about 24.6% KCl by weight, and about 16.4% NaCl by weight.

Figure 1A:
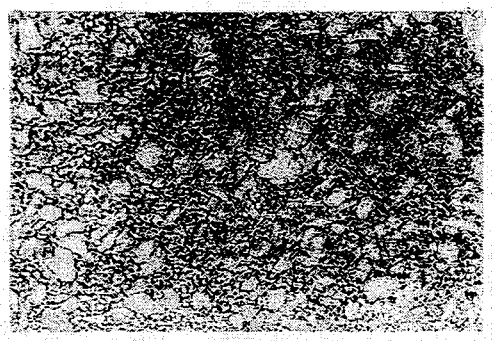
Figure 1B:
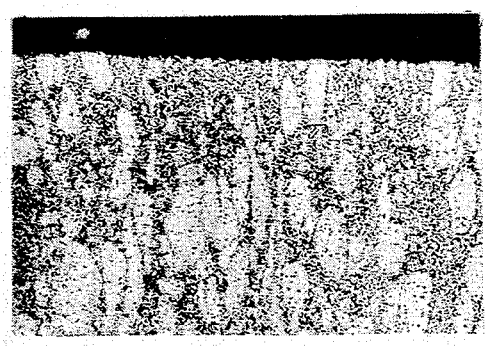
Figure 2A:
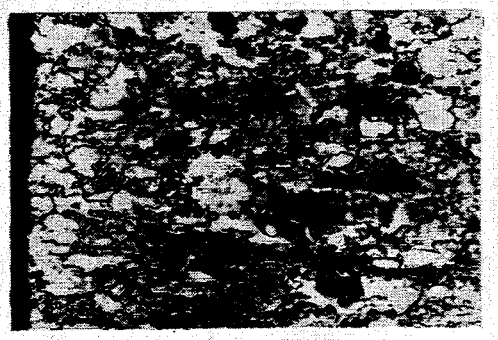
Figure 2B:
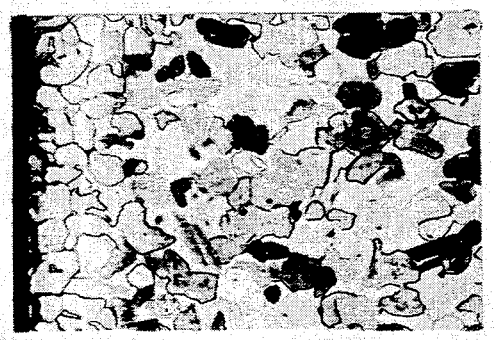
Figure 2C:
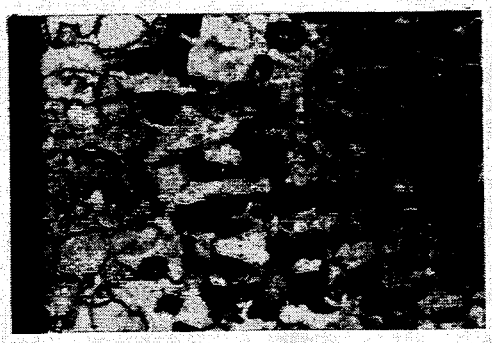
Figure 2D:
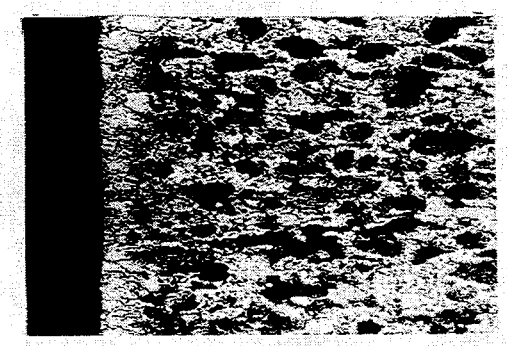
Figure 2E:
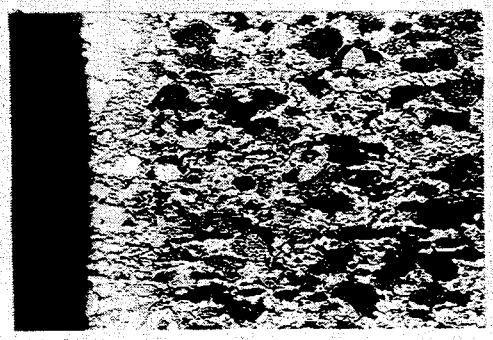
Figure 2F:
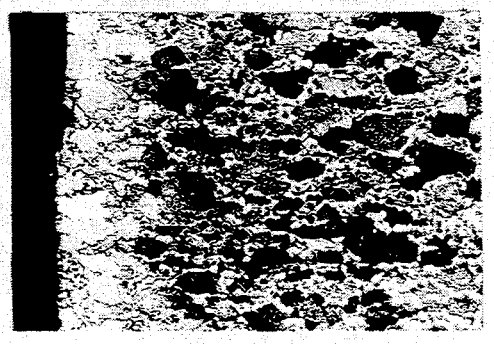
Figure 2G:
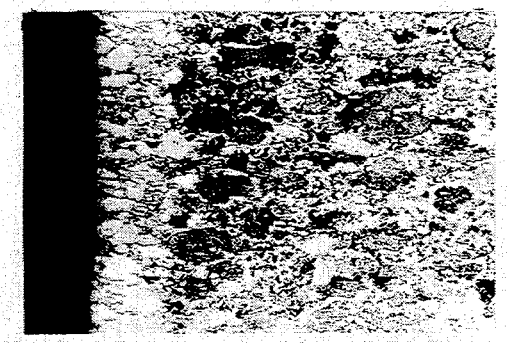
Figure 2H:
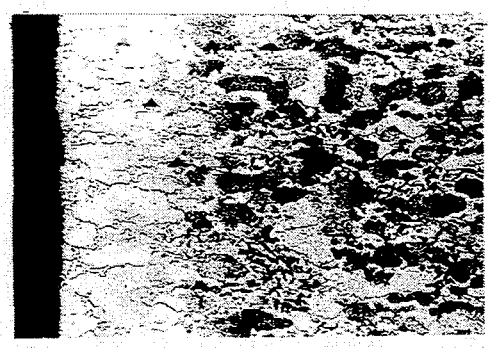
Figure 2I:
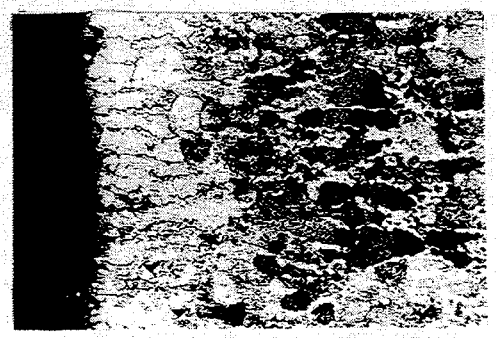
Figure 2J:
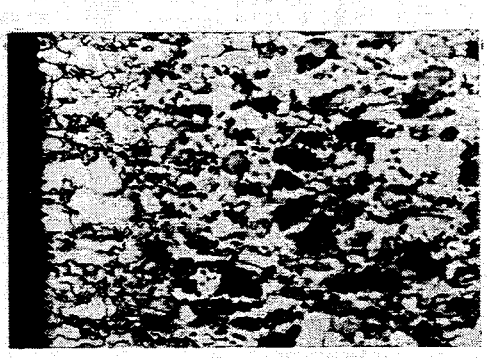
Figure 2K:
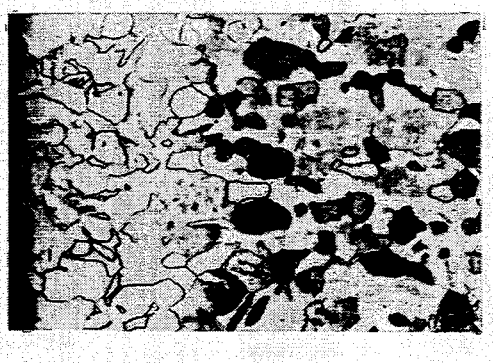
Figure 2L:
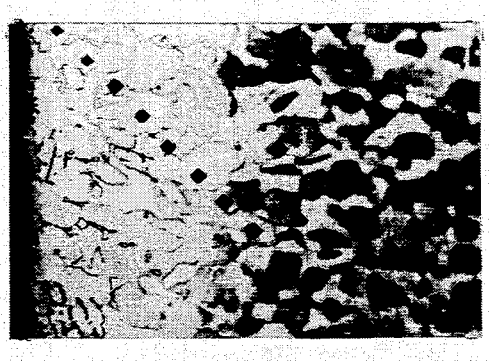
Figure 2M:
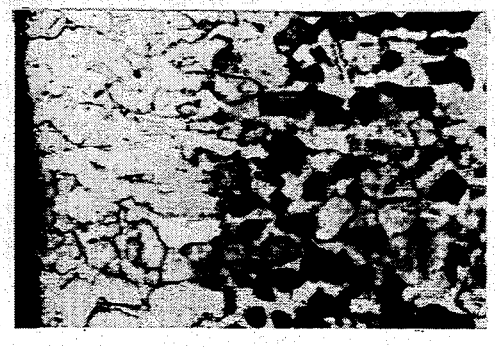
Figure 2N:
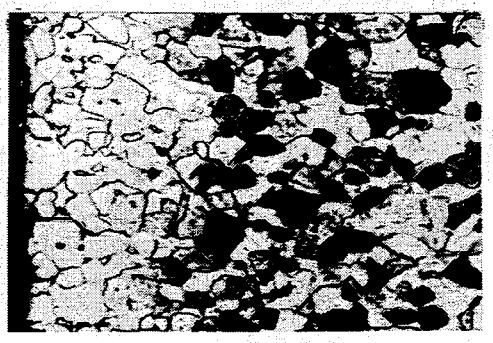

FIGS. 1a and 1b show the microphotographs of the asreceived Ti-6Al-4V alloy. The mean grain size of the equiaxed e phase is approximately 10 μm. The microstructures of cross sections after various carburizing processes are revealed in FIGS. 2a to 2n. The square pits in FIG. 21 shows the results of hardness test on the specimen designated 9333. A white layer is evidently present at the near surface of each specimen. The depth of white layer (DWL) listed in Table II depends on carburizing parameters. A black product which sticks on the outermost surface of specimens after quenching to room temperature were identified by XRD to be a mixture of oxides ($BaTiO_3$, $BaO.TiO_2$ and a relatively small amount of $TiO_2$) and TiC. All the oxides and TiC clad on the outer surface disappear at the deeper near surface (below 10 μm). Therefore, only the diffraction peaks of major element of Ti-6Al-4V alloy, Ti, can be seen in the XRD pattern. It's reasonable to consider that TiC on the outermost surface are derived from the reaction between Ti and C during cathodic carburization and the clad oxides are formed during quenching process. Carbon concentration remains high enough to form TiC during carburization, however, only a small portion of active carbon atoms diffuse into matrix to form α-Ti at the near surface. Low carbon and oxygen

TABLE II

| CARBURIZING PARAMETERS, DWL, ECD AND $H_{max}$ OF EACH SPECIMEN | | | | | | | | | | | | | | |
|---|---|---|---|---|---|---|---|---|---|---|---|---|---|---|
| designation | 7911 | 7912 | 17913 | 8611 | 8612 | 8613 | 8631 | 8632 | 8633 | 9331 | 9332 | 9333 | 933A | 933B |
| parameters | | | | | | | | | | | | | | |
| °C. | 790 | 790 | 790 | 860 | 860 | 860 | 860 | 860 | 860 | 930 | 930 | 930 | 930 | 930 |
| amp/cm$^2$ | 0.1 | 0.1 | 0.1 | 0.1 | 0.1 | 0.1 | 0.3 | 0.3 | 0.3 | 0.3 | 0.3 | 0.3 | 0.3→1.0 | 1.0→0.3 |
| min. | 30 | 60 | 90 | 30 | 60 | 90 | 30 | 60 | 90 | 30 | 60 | 90 | 90→10 | 10→90 |
| DWL (μm) | 10 | 20 | 25 | 10 | 25 | 40 | 30 | 40 | 50 | 30 | 50 | 70 | 50 | 50 |
| ECD (μm) | 65 | 52 | 46 | 47 | 49 | 50 | 50 | 58 | 64 | 57 | 75 | 89 | 78 | 97 |
| Hmax (Hv) | 375 | 412 | 442 | 426 | 459 | 479 | 398 | 474 | 510 | 421 | 516 | 639 | 526 | 544 |

Specimens processed with parameters 7911, 7912, and 7913 were cathodically carburized by using graphite anode at 790° C., 0.1 amp/cm$^2$, 8611, 8612 and 8613 at 860° C., 0.1 amp/cm$^2$, 8631, 8632 and 8633 at 860° C., 0.3 amp/cm$^2$, and, 9331, 9332 and 9333 at 930° C., 0.3 amp/cm$^2$ each set for 30 min., 60 min. and 90 min., respectively. Specimens designated as 933A and 933B were subjected to an extra process operated at 930° C., 1.0 amp/cm$^2$ for 10 min., after and before treated with the same process as applied to the 9333 specimens, 930° C., 0.3 amp/cm$^2$, 90 min., respectively. The carburized specimens were water quenched to room temperature after the carburizing process. Surface roughness was measured by Talysurf 6 system (Rank Taylor-Habson Limited). Microhardness tests were carried out by using a Matsuzawa MXT50 automatic tester under a load of 10 g. Samples for metallographic observations were ground by emery paper, finally polished with 1 μm $Al_2O_3$ powder and etched with 0.5% HF by volume. The clad oxides and carburized layers were analyzed by X-ray diffractometer (XRD).

In a preferred embodiment, titanium alloy is submerged in a molten salt containing carbonate which has an anode and a cathode. The molten salt consists of content of each specimen was also confirmed by using EPMA (Electron Probe Micro-Analysis). The access of oxygen ions to the cathode is supposed to be impossible during an electrolytic process. The loosely clad oxides and TiC formed have no effect on the surface hardening of the processed specimens. Hardening may arise from carbon dissolution in Ti-6Al-4V matrix. Effective carburizing depth (ECD) is defined as the depth where the hardness is less than that of the substrate before carburizing treatment. The ECD of each processed specimen given in Table II was determined directly from the hardness-depth profiles as shown in FIGS. from 3a to 3e. The ECD increases generally with bath temperature, applied current density and carburizing period. The hardness at 20 μm beneath the outermost surface of each specimen is designated as $H_{max}$ and listed in Table II. The hardness enhancement results from combined effects of bath temperature, applied current density and carburizing period. Both ECD and $H_{max}$ should be taken into consideration in the determination of the optimal operating parameter.

In the experiment stated above, surface hardening of Ti-6Al4V alloy can be achieved by cathodic carburizing in a BaCO3-containing molten salt within 790° C.–930° C. A mixture of $BaTiO_3$, $BaO.TiO_2$, $TiO_2$ and TiC formed at the outermost surface of specimens was analyzed by XRD. The major hardening effect is attributed to the diffusion of carbon atoms into the Ti-6Al-4V matrix to form an α-case at the near surface. The effects of bath temperature, applied current density and carburizing period on the surface hardening are mutually dependent. The optimal carburizing parameter obtained is carburized at 930° C., 0.3 amp/cm$^2$ for 90 min. From the result, it could be understood that surface hardening of titanium alloys which comprise α phase can be achieved by cathodic carburizing in a carbonate-containing molten salt.

While the invention has been described by way of an example and in terms of several preferred embodiments, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A process of surface hardening for a titanium alloy having α phase by carburization, comprising the steps of:

(a) submerging said titanium alloy in a molten salt which contains carbonate and which has an anode and a cathode therein;

(b) maintaining said titanium alloy in contact with said cathode;

(c) passing an electric current between said anode and cathode;

(d) disconnecting said titanium alloy from said cathode; and (e) cooling said titanium alloy.

2. A process of surface hardening for a titanium alloy having α phase by carburization as claimed in claim 1, wherein:

said molten salt is maintained at a temperature between about 790° C. and 930° C.

3. A process of surface hardening for a titanium alloy having α phase by carburization as claimed in claim 1, wherein:

said molten salt is maintained at a temperature of about 930° C.

4. A process of surface hardening for a titanium alloy having α phase by carburization as claimed in claim 1, wherein:

said molten salt consists of about 30% $BaCO_3$ by weight and about 70% No. 660 by weight, said No. 660 consisting of about 59% $BaCl_2$ by weight, about 24.6% KCl by weight, and about 16.4% NaCl by weight.

5. A process of surface hardening for a titanium alloy having α phase by carburization as claimed in claim 1, wherein:

the density of said electric current is between about 0.1 amp/cm$^2$ and 0.3 amp/cm$^2$.

6. A process of surface hardening for a titanium alloy having α phase by carburization as claimed in claim 1, wherein:

the density of said electric current is about 0.3 amp/cm$^2$.

7. A process of surface hardening for a titanium alloy having α phase by carburization as claimed in claim 1, wherein:

said molten salt is maintained at a temperature of about 930° C., and the density of said electric current is about 0.3 amp/cm$^2$.

* * * * *